United States Patent [19]

Frederiksen

[11] Patent Number: 4,807,412

[45] Date of Patent: Feb. 28, 1989

[54] GRATING OR MAT ELEMENT

[75] Inventor: Ruth Frederiksen, Lystrup, Denmark

[73] Assignee: JYDSK Fjederfabrik A/S, Lystrup, Denmark

[21] Appl. No.: 53,877

[22] Filed: May 26, 1987

Related U.S. Application Data

[63] Continuation-in-part of Ser. No. 897,790, Aug. 19, 1986, abandoned, which is a continuation of Ser. No. 780,000, Jun. 21, 1986, abandoned.

[51] Int. Cl.[4] ..... B44D 5/08

[52] U.S. Cl. ..... 52/177; 52/180; 52/589

[58] Field of Search ..... 52/177, 180, 181, 589; 446/113, 111, 120; 404/35, 36, 41

[56] References Cited

U.S. PATENT DOCUMENTS 3,500,606 3/1970 Wharmby ..... 52/594 X 4,468,910 9/1984 Morrison ..... 52/177 X 4,584,221 4/1986 Küng ..... 52/177

FOREIGN PATENT DOCUMENTS 1408524 10/1975 United Kingdom ..... 52/177

*Primary Examiner*—Carl D. Friedman

*Attorney, Agent, or Firm*—Antonelli, Terry & Wands

[57] ABSTRACT

A flooring made of intercoupled mat or flag or members of plastic, with these elements having, on each side, a set of integrally shaped coupling members, which are invisible on the surface of the tightly juxaposed elements or members, but allow the elements or members to be joined and separated by a relative, vertical displacement of the elements. The coupling members are designed and arranged such that, for joining or separating the elements in each central area of four elements in a square, it is necessary to bend and twist one or more of the elements resiliently, such that an unintensional disconnection of the elements or members is impossible.

7 Claims, 3 Drawing Sheets

GRATING OR MAT ELEMENT

This application is a continuation in part of application Ser. No. 897,790, filed Aug. 19, 1986, now abandoned, which is a continuation of application Ser. No. 780,000 filed June 21, 1986, now abandoned.

BACKGROUND OF THE INVENTION

The present invention relates to a flooring assembly of rectangular plastic mat elements each shaped as a flat flag member having a top plate portion, a circumferential edge flange depending from an edge of the top plate portion, a circumferential side flange depending from an edge of the top plate portion, and a plurality of floor engaging carrier portions depending from an underside of the top plate portion and with the mat elements being provided with connector means, whereby the mat elements are releasably joinable side to side.

Mat elements or flag members of the aforementioned type can be constructed as robust units, which are nevertheless slightly resilient, whereby the mat elements or flag members, compared with, for example, a concrete floor, are more comfortable to walk and stand on. Additionally, for other reasons, such a flooring is advantageous in many types of floors such as, for example, in workshops, exhibition areas, and many other places. With the use of flag members of a convenient size of, for example, 25×25 cm, it is possible to tailor the flooring in situ according to the requirements of a particular location.

The flooring may be arranged around or in front of working machines or positions, along walkways, on areas tending to become wet and slippery, etc., and the flooring is flexible in the same manner that the arrangement of the flag members can be changed when desired or required.

When the flag members are joined in a releasable manner, any sub-area of the flooring can be disconnected and moved to another place and then be rejoined with the flooring at such other place. Of course, the sub-area itself may be rearranged or divided in connection with the change.

However, it is an associated problem that the flag members should be both safely joinable, such that a sub-assembly of the flooring can be handled as a safely coherent structure, and easily separable anywhere throughout the flooring area, so that the separation and rejoining can be effected easily not only on the flag member by the flange, but even along a straight or broken line between the respective coherent flooring areas each comprising many flag members.

In most of the known proposals preference is given to the easy separability. The connector means are shaped such that one edge of a flag member is lowerable over an edge portion of the neighboring flag member to thereby provide a holding engagement between generally vertically oriented interlocking portions. Hereby the holding engagement can be released anywhere, by local lifting of the desired of the edges flange member, but it will be an associated problem that the general coherence in any assembled sub area of the flooring will be low whenever such an area is not rested firmly against the floor, for example, when it is being moved from one place to another by a rearrangement of the flooring.

According to another known proposal preference is given to a safe joining of the flag members, in that the interlocking means comprise movable connector members which are manually operable to be shifted between a retracted inoperative position and an active position, in which a safe interlocking of the adjoining edges of the flag member is secured. However, the actuation of such flag members will require a free access to the underside of the flag members, and, in practice, this will mean that the locking means are accessible only adjacent the outermost edges of any preassembled flooring area. Thus, it is simply impossible to arrange for a separation of a flooring area along a straight or broken line well spaced from the contour of the area, because the manually shiftable interlocking members will simply not be accessible.

It is the purpose of the present invention to provide a flooring of the aforementioned type, which is reasonably easy to separate along any desired line even remote from the outer edges of the flooring area, while a generally very effective coherence between the flag members is not renounced, such that any separated sub area of the flooring may be handled as a unit which will not be liable to disintegrate when it is moved or even thrown around. According to the invention the interlocking connector means are arranged in such a manner that they will require a vertical bending of each respective flag member edge in order to be released from and joined to the complementary locking means or the neighboring flag member, and such a bending cannot, in practice, be effected unintentionally. On the other hand, it may be effected anywhere along the joining lines between the flag members, without requiring acess from a free edge of the flooring area.

A high priority should be given to the coherence between the flags, even so they will resist some unintentional lifting without separating. It will be in order, therefore, that they can be separated only by a pronounced intentional and even strength requiring dislocking, whereby the edges of the flag members edges should be heavily resiliently bent and the flag members correspondingly twisted.

The invention is based on the recognition that a very safe and yet releasable locking is achievable when the interengaging locking members are arranged relatively close to the corners of the flags in a countersymmetrical manner such that at one side of the corner the flag members is liftable from the neighboring flag members, while at the other side of the same corner the flag members is not liftable from the respective adjoining flag member or rather it is liftable therefrom in the opposite direction only. Therefore, the release lifting of a flag member side adjacent the corner will be resisted by the maintained locking engagement in the nearby area at the other leg of the corner such that an effective release is possible only by a pronounced bending and twisting of the adjoining portions of the flag member.

Under these conditions the interacting locking members may be provided as integral portions of the flag members, such that separate joining members may be avoided and the flag members may be entirely uniform at least as far as the locking members are concerned. It has been found advantageous to manufacture the flag members in various series, all having the same main dimensions so as to be interengageable, but provided with different top surface designs, e.g. with large holes, small holes and no holes at all, whereby the user may compose the flooring with sub areas of respective desired surface characteristics.

In the following the invention is described in more detail with reference to the drawings.

DETAILED DESCRIPTION

Figure 1:
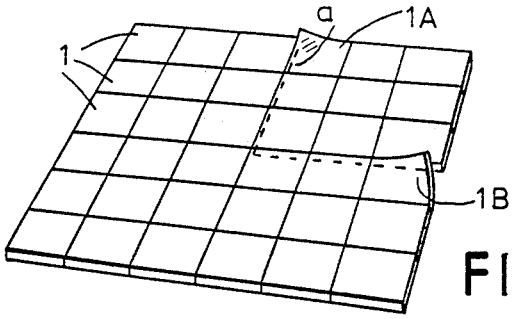
FIG. 1 is a schematic perspective view of a flooring according to the invention.
Figure 2:
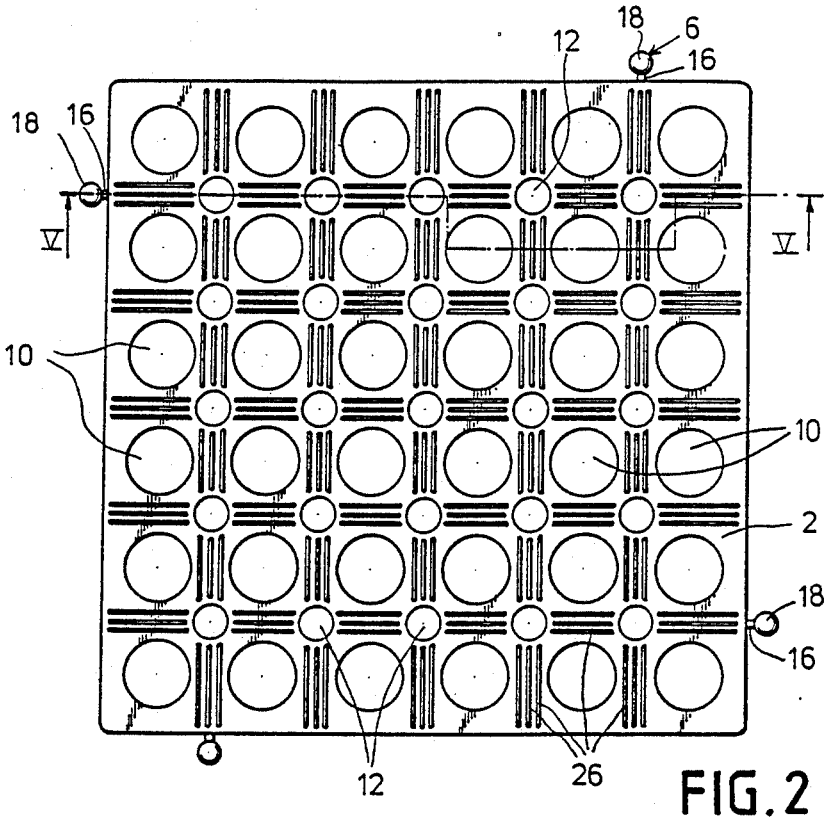
FIG. 2 is a top view of a flag member used in the flooring.

In FIG. 1 is illustrated a flooring comprising a plurality of square flag members 1, which are interlocked edge to edge. The flag members 1 are made of resilient plastic and are designed such that they are joinable and separable by being bent and twisted as shown in dotted lines for two flag members 1A and 1B. In the example shown, it is presumed that the flooring is desired to be separated along a dotted line a in order to release a portion thereof for removal or for remounting at some other edge area of the flooring, and it is illustrated that the disconnection may be effected by a bending up of the edges of the flag members 1 either at one side 1A or at the other side 1B of the line a. Principally it would be sufficient to effect a bending of the flag members 1 at only one side of the line a, but since a downward bending is not possible when the flooring is supported on a rigid floor, a corresponding effect is obtained by bending upwardly the edge of the adjoining flag member 1 at the other side of the line a.

The flag members 1 are principally identically shaped, one of them being illustrated in more detail in FIGS. 2–5. The flag member is a die cast plastic member comprising a top plate portion 2 having along its outer edge a depending edge flange 4 provided with a protrusion 6 near each corner, to the right thereof. Spaced similarly, from the corner to the left thereof, the edge flange 4 is shaped with a vertical slot 8 opening towards an interior recess as described below. The top plate portion 2 is provided with a plurality of relatively large holes 10 and with another plurality of smaller holes 12, the edges of the latter being connected with downwardly extending butular portions 14 extending down to the underlying rigid floor surface.

The protrusions 6 of each include a vertical, narrow rib portion 16 carrying an outermost head portion 18, which is shaped as a vertically cylindrical block member having a rounded top portion located beneath the lower side of the top plate 2, with the top edge of the rib portion 16 being located at a still lower level.

The vertical slots or depressions generally designated by reference numeral 8 each comprises a vertical slot 20 in the edge flange 4, open from the lower edge thereof up to a level just beneath the bottom side of the top plate portion 2, with each slot 20 opening into a downwardly open, cylindrical recess 21 inside a wall portion 22. The recesses 21 correspond in width and height to the shape of the head portions 18. The recesses 21 may extend upwardly to a level slightly above the top level of the head portions 18, but still beneath the level of the top plate portion 2, such that the recesses 21 do not break through the top surface of the flag member.

Mutually orthogonal rib portions 24 along the underside of the top plate 2 extend between the upper ends of the neighboring tubular portions 14 as horizontal reinforcing ribs for the top plate 2. On its top side, the top plate 2 is shown provided with a pattern of slightly elevated rib portions 26 for improving the non-skid properties of the flag member.

The edge flanges 4 are each provided with a pair of downwardly open recesses 25, which are located in a symmetrical manner such that, when the flag members are assembled into a flooring (FIGS. 1 and 7) these, recesses 25 of the adjoining flag members will be located flush with each other and thus provide for a break through, which will enable a drainage of water or the drawing of electric cables along the floor, underneath the flag members.

With the described design and with the choice of a suitably flexible and resilient plastic, the flag members are very convenient and even healthy to walk and stand on, as the location of the support portions 14 has been selected according to recognized zonal therapeutic principles.

The flag members, as mentioned above, are joinable edge to edge by way of intercoupling of the respective head portions 18 and recesses 21, and it is to be noted that these elements are located entirely beneath the top plate portion 2 such that they will be completely invisible in the assembled flooring. In other words the flooring will present itself as flag members laid neatly together, without any visible signs of applied intercoupling means.

The top plate portion 2 may be designed otherwise, for example, with holes 10 of reduced size or even without holes 10. Even the holes 12 may be avoided, as the plate material can be arranged to extend across the upper end of the tubular support portions 14. Correspondingly, these portions should not necessarily be tubular.

The main concern of the present invention relates to the intercoupling of the flag members. Obviously, when the intercoupling means are arranged entirely beneath the top side of the flag members, it will not be possible to disengage two neighboring flag members merely by lifting anyone of them from the other, inasfar as only one of the flag members will be liftable from the other. Moreover, since there is provided along each flag member side one protrusion 6,18 and one recess 20,21 it will be required, for joining or separation of edges of the flag member, to move one end of a flag members side upwardly and the opposed end of the flag member side downwardly relative the corresponding edge portions of the adjoining flag member.

Figure 3:
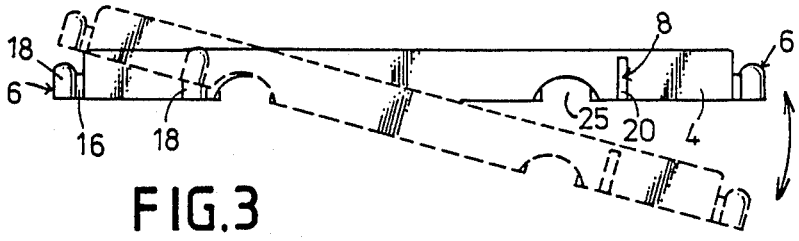
FIG. 3 is a side elevation of the flag member.
Figure 4:
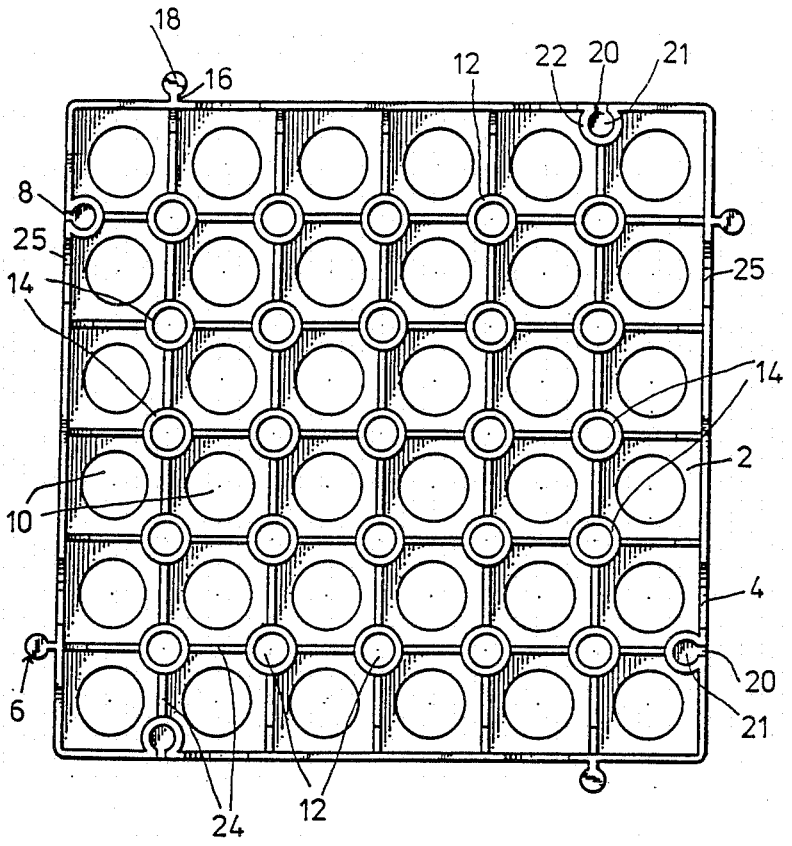
FIG. 4 is a bottom view thereof.
Figure 5:
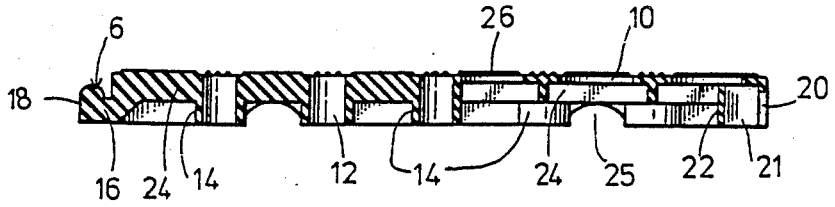
FIG. 5 is a sectional side view thereof.

Thus, as shown in dotted lines in FIG. 3 two flag members 1 may be tilted or threadably secured together or apart, and, when the cooperating cylindrical heads 6 and recesses 21 are parallel and in tight engagement already, such a joining or separation by tilting cannot be effected without a certain resilient bending of the locking portions 6,16 and 20,22, whereby a certain self-locking action between the flag members is obtained.

Figure 6:
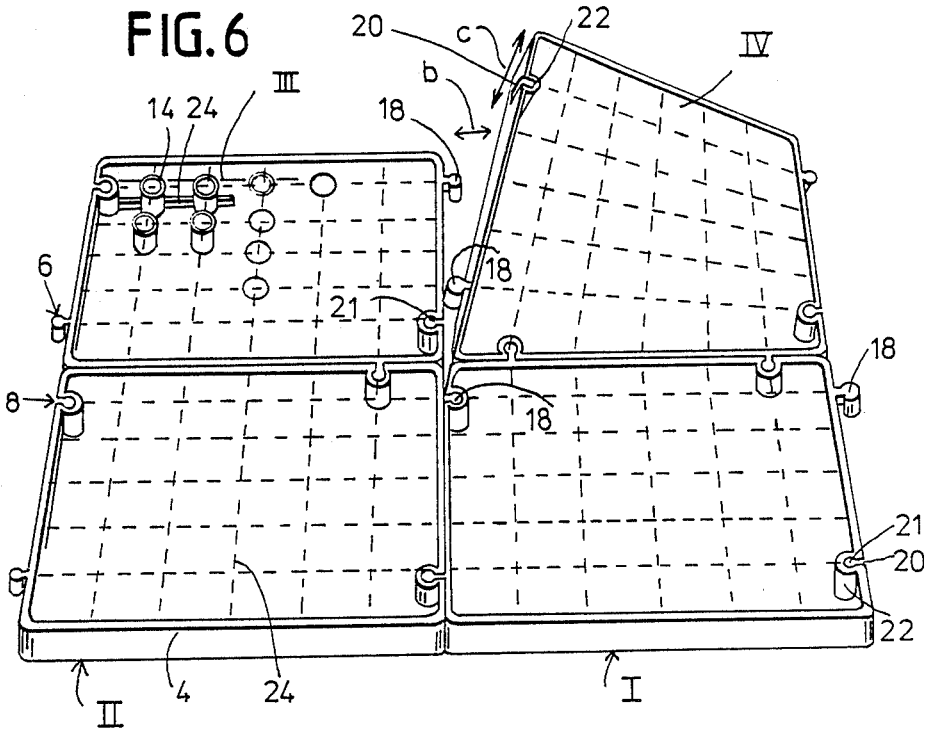
FIG. 6 is a perspective top view illustrating four adjoining flag members.
Figure 7:
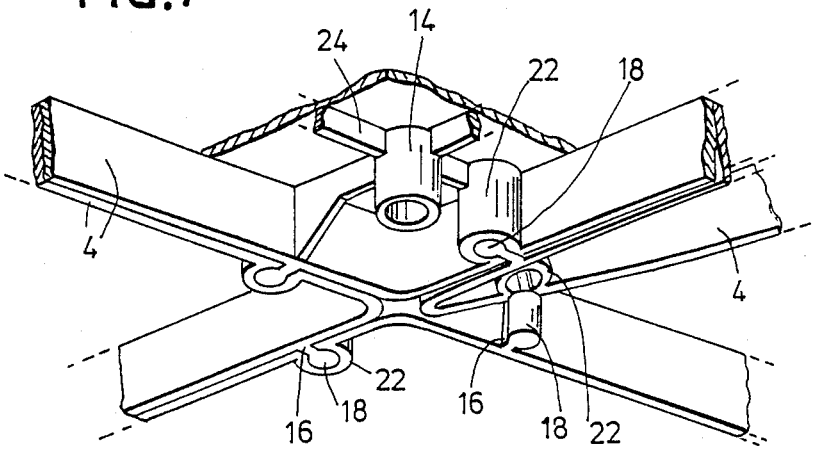
FIG. 7 is a more detailed view, seen from below, of the common corner area of the four flag members shown in FIG. 6.

However, a much more pronounced self-locking is obtained whenever four flag members I, II, III, IV are joined into a square as illustrated in FIGS. 6 and 7, Three of the flag members are easily joinable by respective threading or tilting movement as illustrated in FIG. 6, but the situation then arises that the "center corner"

portion of the fourth flag member should have its associated head member 6 introduced into the corresponding recess 21 of the neighboring flag member III from one side of the plane of the preassembled flag members I, II, III, IV, while at the other side or leg of the corner the recess 21 of the fourth flag member IV should be introduced over the head portion 6 of the repsective neighboring flag members from the other side of the plane. This requires a rather widegoing resilient bending or twisting of both the fourth flag members IV and the adjoining locking portions of the respective neighboring flag members. The fourth flag member should not only be twisted, but also be bent or drawn away from the third flag member III in order to enable the protruding head portion 6 to be moved into a position, from which it is introduceable into the recess 21 of the third flag member III. This drawing apart of the adjoining edges is illustrated by an arrow b in FIG. 6, while the associated required twisting is illustrated by an arrow c.

Thus, the joining of each sub unit of the four flag members I, II, III, IV will require the use of a considerable, yet acceptable manual force, but on the other hand, once the flag members have been joined in sub groups of four flag member (as present around each corner joint in the flooring, except near the edges thereof) the flag members will be joined such that they can be separated only by a correspondingly difficult manual work, which requires a high degree of coordination between bending, drawing and twisting. A separation, therefore, cannot possibly occur unintentionally, and once a section of the flooring has been separated as along the line a in FIG. 1 this section will remain absolutely coherent by the following handling thereof, almost no matter how roughly it is treated, and it can be moved to another position along the edge of the same or another corresponding flooring area. Here the joining is effected as described above, starting preferably from one end of the joining line, practically all of the corners along the joining line now being "center corners" at the middle of four surrounding flag members.

It will be understood that the flag members will be separable by the same movements as described for the joining, though carried out in inverted manner. By the separation, as also by the joining, it will normally be necessary to lift off at least one end of the respective edges of the flag member from the floor, and this, of course, is facilitated when the top plate portion 2 is provided with holes 10 large enough to permit introduction of a finger tip.

While the flag members should be resilient enough to allow for the described required bending etc. without the necessary manual force having to be inconveniently high, the resiliency should not be so high as to enable a mere retraction of the locking heads 6 from the recesses 21 in the horizontal direction, or at least this should require quite excessive forces, such that the flooring will be resistant to heavy separation forces as may occur e.g. in factories as for example by truck driving on the flooring. However, the sub portions responsible for the holding of the heads 6, viz. the part-cylindrical portions 22, constitute local, concentrated structures which, despite the general resiliency of the flag members, are rigid enough to withstand a direct, horizontal retraction of the cooperating head portion 6.

What is claimed is:

1. A flooring assembly comprising at least four flag members made of plastic and each shaped as a rectangular flat body having a top plate portion, a circumferential edge flange depending from the edge of said top plate portion, and a plurality of floor engaging carrier portions depending from the undersigned of the top plate portion, said flag members having, at each of side edges thereof, a set of locking members, which, for each pair of juxtaposed flag members, are interengageable for locking the flag members together, said set of locking members of each flag member side comprising respective complementarily shaped first and second locking members located spaced from each other symmetrically about a middle of the flag member side, said first locking members includes locking head portions arranged outwardly protruding from the respective edges of the flag members on respective connector portions of a width dimension less than a width of the head portions, said second locking members being constituted by downwardly open cavities for receiving said locking head portions by a relative substantially vertical insertion movement, said cavities being arranged inwardly spaced from the outside of the respective edge flange corresponding to the protrusion of the said head portions therefrom, and relatively narrow connector slot channels being provided between an outermost side area of said cavities and the adjacent outer surface of the edge flange, whereby said connector portions of the locking head portions are receivable in said connector slot channels by said insertion of the head portions into said cavities, all of said locking head portions, connector portions, cavities and connector slot channels being arranged beneath a level of said top plate portion for enabling the same to extend unbroken over said cavities and connector slot channels, said locking head portions and connector portions being provided integrally with the respective flag members as rigid and permanently projecting parts thereof, and said flag members being generally resilient so as to be bendable and twistable sufficiently to enable the locking members of each pair of juxtaposed flag members in the flooring assembly to be caused to engage or disengage each other, respectively, by a relative insertion or retraction movement substantially in the vertical direction such that the joining and separation of the central area of each group of four flag members requires a considerable flexing and twisting of at least one of the flag members.

2. A flooring assembly according to claim 1, in which said top plate portion is provided with perforations at least along the edges thereof.

3. A flooring assembly according to claim 1, in which said top plate portion is provided with perforations evenly distributed throughout the plate portion.

4. A flooring assembly according to claim 3, in which the perforations are provided as top holes of said floor engaging carrier portions, these being shaped as tubular portions.

5. A flooring assembly according to claim 1, in which the top sides of said head portions are of a convex shape.

6. A flooring assembly according to claim 1, in which the top plate portion is provided with a system of reinforcing ribs on an underside thereof.

7. A flooring assembly according to claim 1, in which the edge flange of each side of each flag member is provided with at least one recess or notch in the lower edge thereof, such that at least one through-passage is provided in the adjoining edge flanges of each pair of juxtaposed flag elements.

* * * * *

UNITED STATES PATENT AND TRADEMARK OFFICE

CERTIFICATE OF CORRECTION

PATENT NO. : 4,807,412

DATED : February 28, 1989

INVENTOR(S) : R. Fredericksen

It is certified that error appears in the above-identified patent and that said Letters Patent is hereby corrected as shown below:

On the title page Insert
-- Foreign Application Priority Data

Sept. 25, 1984 [DN] Denmark ..... 4592/84 --.

Signed and Sealed this

Thirtieth Day of January, 1990

*Attest:*

JEFFREY M. SAMUELS

*Attesting Officer*

*Acting Commissioner of Patents and Trademarks*